US006777860B2

(12) United States Patent
Franck

(10) Patent No.: US 6,777,860 B2
(45) Date of Patent: Aug. 17, 2004

(54) LUMINOUS ELEMENT FOR LAMP

(75) Inventor: Felix Franck, Munich (DE)

(73) Assignee: Patent Treuhand-Gesellschaft fur Elektrische Gluhlampen mbh, Munich (DE)

( * ) Notice: Subject to any disclaimer, the term of this patent is extended or adjusted under 35 U.S.C. 154(b) by 0 days.

(21) Appl. No.: 10/169,878

(22) PCT Filed: Nov. 30, 2000

(86) PCT No.: PCT/DE00/04272

§ 371 (c)(1),
(2), (4) Date: Jul. 9, 2002

(87) PCT Pub. No.: WO01/52305

PCT Pub. Date: Jul. 19, 2001

(65) Prior Publication Data

US 2003/0001480 A1 Jan. 2, 2003

(30) Foreign Application Priority Data

Jan. 12, 2000 (DE) ..... 100 01 007

(51) Int. Cl.[7] ..... H01K 1/14

(52) U.S. Cl. ..... 313/344; 313/574; 313/631; 313/326; 445/48; 140/71.5

(58) Field of Search ..... 313/341–344, 313/491, 628, 574, 631, 315, 316, 326, 578, 331, 333, 271, 272, 273, 274; 445/48, 49; 140/71.5

(56) References Cited

U.S. PATENT DOCUMENTS

| | | | | |
|---|---|---|---|---|
| 1,143,909 A | | 6/1915 | Jaeger | |
| 1,279,789 A | | 9/1918 | Tilley | |
| 1,600,563 A | | 9/1926 | Proctor | |
| 1,858,676 A | * | 5/1932 | McCullough | 313/103 R |
| 5,811,934 A | | 9/1998 | Bunk et al. | |
| 6,600,255 B1 | * | 7/2003 | Kai et al. | 313/271 |

FOREIGN PATENT DOCUMENTS

| | | |
|---|---|---|
| DE | PS 482360 A | 9/1929 |
| DE | 44 20 607 A1 | 12/1995 |
| DE | PS 104298 X | 1/1998 |
| FR | 470 744 A | 9/1914 |
| FR | 871 324 A | 4/1942 |

* cited by examiner

*Primary Examiner*—Edward J. Glick
*Assistant Examiner*—Elizabeth Keaney
(74) *Attorney, Agent, or Firm*—Frishauf, Holtz, Goodman & Chick, P.C.

(57) ABSTRACT

A luminous element (10) for a lamp is double helix-shaped, with two connection parts (18, 20) situated at one end of said double helix. The diameter (D1, D2) of the double helix increases consistently in the direction of the two connection parts (18, 20) of the luminous element (10). The invention also relates to a lamp with a luminous element of this type, to a method for producing a luminous element of this type and to a device for carrying out the production method.

20 Claims, 4 Drawing Sheets

LUMINOUS ELEMENT FOR LAMP

This application is a U.S. National Phase Application under 35 USC 371 of International Application PCT/DE00/04272 filed Nov. 20, 2000.

TECHNICAL FIELD

The present invention relates to a luminous element for an incandescent lamp, in particular a luminous element having the shape of a double helix, with two terminals arranged at one end of the double helix. It also relates to an incandescent lamp having such a luminous element, a method for producing such a luminous element, and a device for carrying out the method of production.

PRIOR ART

A luminous element is disclosed in DE 44 20 607 (which corresponds to U.S. Pat. No. 5,811,934), see FIG. 3 there and its associated description. Such a luminous element has the disadvantage, however, that it is very susceptible to the flashovers in the region of the lowermost pair of turns. Because of tolerances in the production of the luminous element, during pinching of the luminous element, that is to say its mounting in a base, deformations are produced that lead to an exacerbation of said problem.

SUMMARY OF THE INVENTION

It is an object of the present invention to provide a luminous element for an incandescent lamp that has a reduced susceptibility to flashovers, in particular in the region of the lowermost pair of turns.

This object is achieved in the case of a luminous element for an incandescent lamp by the luminous element having the shape of a double helix with two terminals arranged at one end of the double helix. The diameter of the double helix increases continuously in the direction of the two terminals of the luminous element. The mutual spacing of adjacent turns from one another in space is enlarged by the measure according to the invention. This results in a substantially lower sensitivity to position tolerances during pinching.

The embodiment according to the invention continues to offer the advantages known from the prior art: for example, the currents flowing in the respectively adjacent turns are always in opposite directions. The individual turns therefore repel one another in opposite directions because of the filament current. By comparison with a simple helix, the electric inductance for the double helix is substantially lower, that is to say the lamp is more efficient as regards its generation of useful radiation, and emits less electromagnetic interference. Furthermore, the design of a luminous element in accordance with a double helix permits the active filament length to be adjusted continuously, since the orientation of the transverse connection of the two halves of the double helix can be selected at will with reference to the terminals. This results in a far-reaching complete design freedom for the variables of diameter, height, wire thickness and power.

In the case of a particularly advantageous embodiment, it is not only the diameter of the double helix that increases continuously in the direction of the two terminals of the luminous element, but also the lead of the turns, that is to say the spacing of adjacent turns from one another. This results in a further enlargement of a three-dimensional spacing. The second measure, that is to say the increase in the lead of the turns alone, does not achieve the above named object, since the double helix has the lowest mechanical stability at the end at which the terminals are located. Consequently, if only the lead of the turns is enlarged, this results in an even lower mechanical stability. Movements inside the body of the lamp, in particular owing to the inductive processes during switching on, therefore lead to an even greater readiness to short circuit. The sensitivity to position tolerances during pinching is also not reduced in the case of sole application of the second measure, since these position tolerances chiefly occur transverse to the longitudinal axis of the luminous element.

The purpose of the continuous increase is to bring about a continuous enlargement of the three-dimensional spacing of the turns since, when only the last two turns have a larger spacing from one another, the problem is displaced onto the last turn but one. Consequently, continuous increase is to be understood, in particular, as a linear, quadratic, cubic or exponential increase.

The invention also relates to a method for producing a luminous element comprising fixing a wire forming the luminous element on the first end of a rotationally symmetrical winding spindle whose diameter increases continuously from its first end up to a winding end section; winding the wire on the winding spindle between a first end and the winding end section, the turns being arranged offset on the winding spindle; and drawing the luminous element off from the winding spindle. Furthermore, the invention also relates to a device for carrying out the method of production.

In a particularly advantageous embodiment of the method according to the invention, the wire forming the luminous element is inserted simply into a notch on the narrow end of the winding spindle before the double helix is formed by winding the wire on the spindle. In order to observe very close tolerances, it is particularly advantageous to bend the terminals into shape as early as in the state in which the double helix is wound stably onto the winding spindle. For this purpose, each free wire end is bent over on a bent-over section of the winding spindle such that after being bent over the wire ends are orientated substantially in the direction of the longitudinal axis of the winding spindle. As a result of this there is no need to append any subsequent processing step that would have the purpose of bending the terminals into shape. This leads to a minimization of the risk of undesirably bending the luminous element out of its optimum shape. Winding the wire on the winding spindle can be achieved by rotating the wire about a fixed winding spindle, or rotating the winding spindle about its longitudinal axis between non-rotating wire feeds. In order to achieve a particularly advantageous embodiment of the luminous element, this relative movement can be performed in such a way that the lead of the turns on the winding spindle increases continuously from the narrow end of the winding spindle to the winding end section.

Further advantageous embodiments of the invention can be added from the sub claims.

DESCRIPTION OF THE DRAWINGS

Exemplary embodiments of the invention are described in more detail below with reference to the attached drawings, in which.

DETAILED DESCRIPTION

Figure 1:
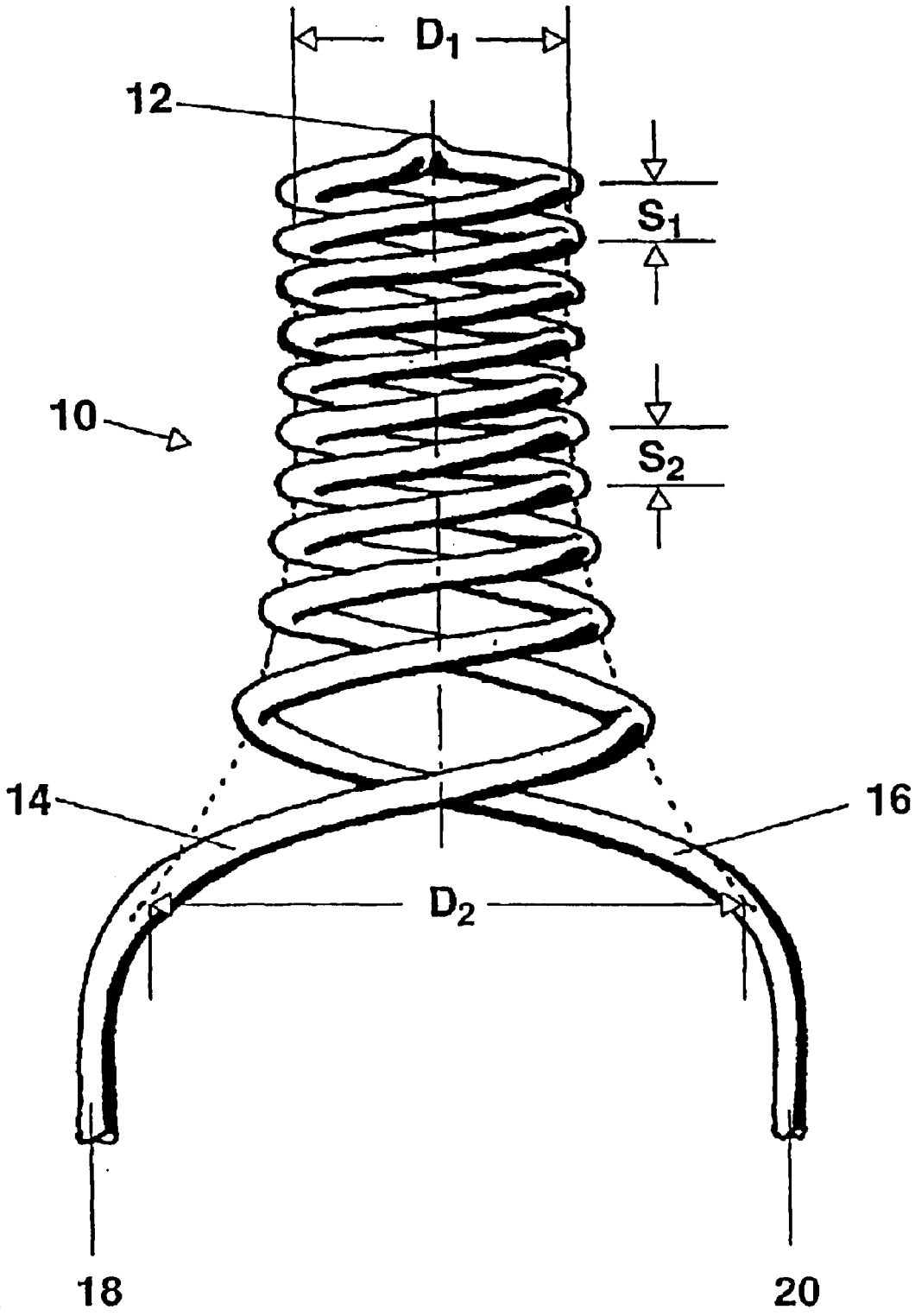
FIG. 1 shows a side view of a luminous element according to the invention.

FIG. 1 shows a luminous element 10 in the shape of a double helix. In this case, a departing section 14 is connected via a transverse connection 12 to a returning section 16. The luminous element 10 has the shape of a double helix. The turns of the double helix have a diameter D1 at the end of the transverse connection 12, and a diameter D2 at the end of the terminals 18, 20. At the end of the double helix where the transverse connection 12 is situated, the turns have a lead S1, while at the end where the terminals 18, 20 of the luminous element 10 are situated they have a lead S2. Whereas the diameter rises continuously from D1 to D2 from the transverse connection end to the terminal end, the lead of the turns is enlarged continuously from S1 to S2 from the transverse connection end to the terminal end. In the present case, the continuous increase takes place exponentially. The continuous nature of the increase is essential, and so a quadratic, cubic or exponential increase also comes into consideration, in particular.

FIGS. 2*a*–2*f* show a sequence of steps that illustrate a method for producing the luminous element according to the invention.

Figure 2A:
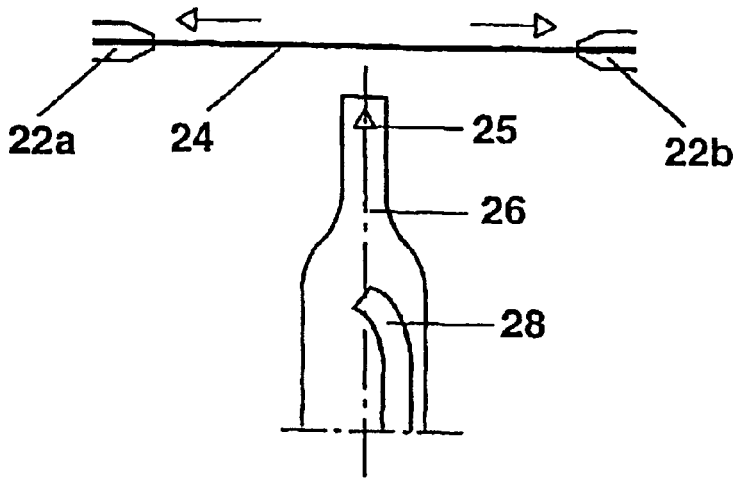
FIGS. 2*a*–2*f* show a sequence for explaining the method of production according to the invention.
Figure 2B:
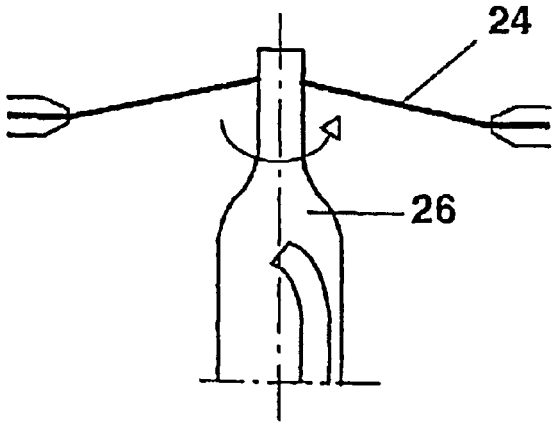
Figure 2C:
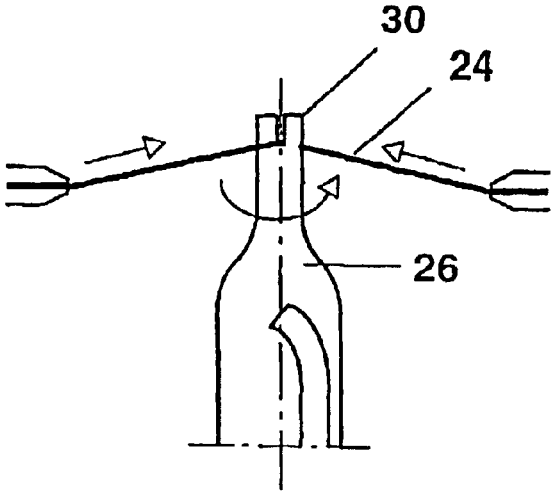
Figure 2D:
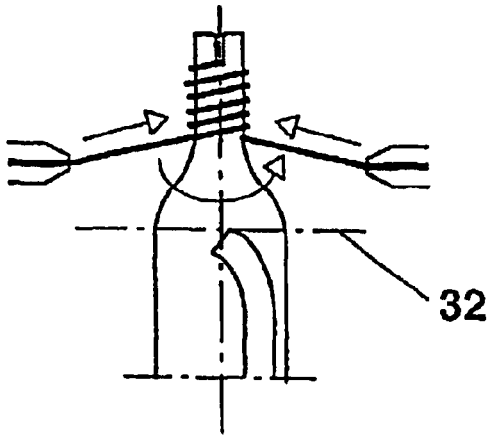
Figure 2E:
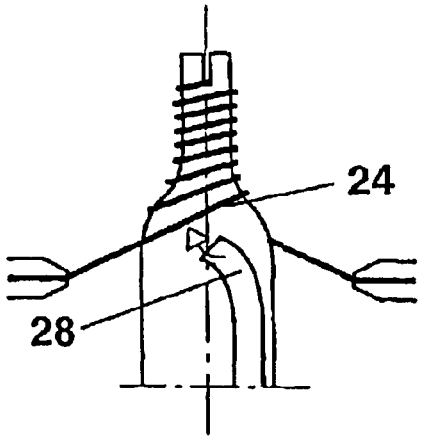
Figure 2F:
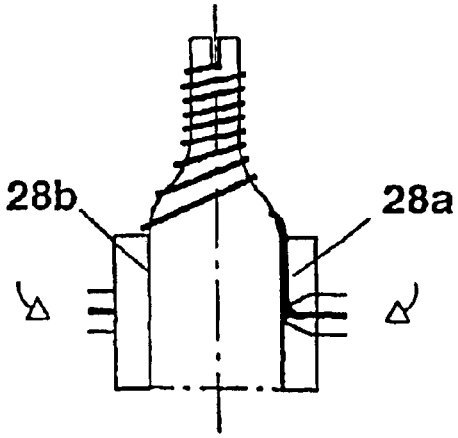
Figure 3:
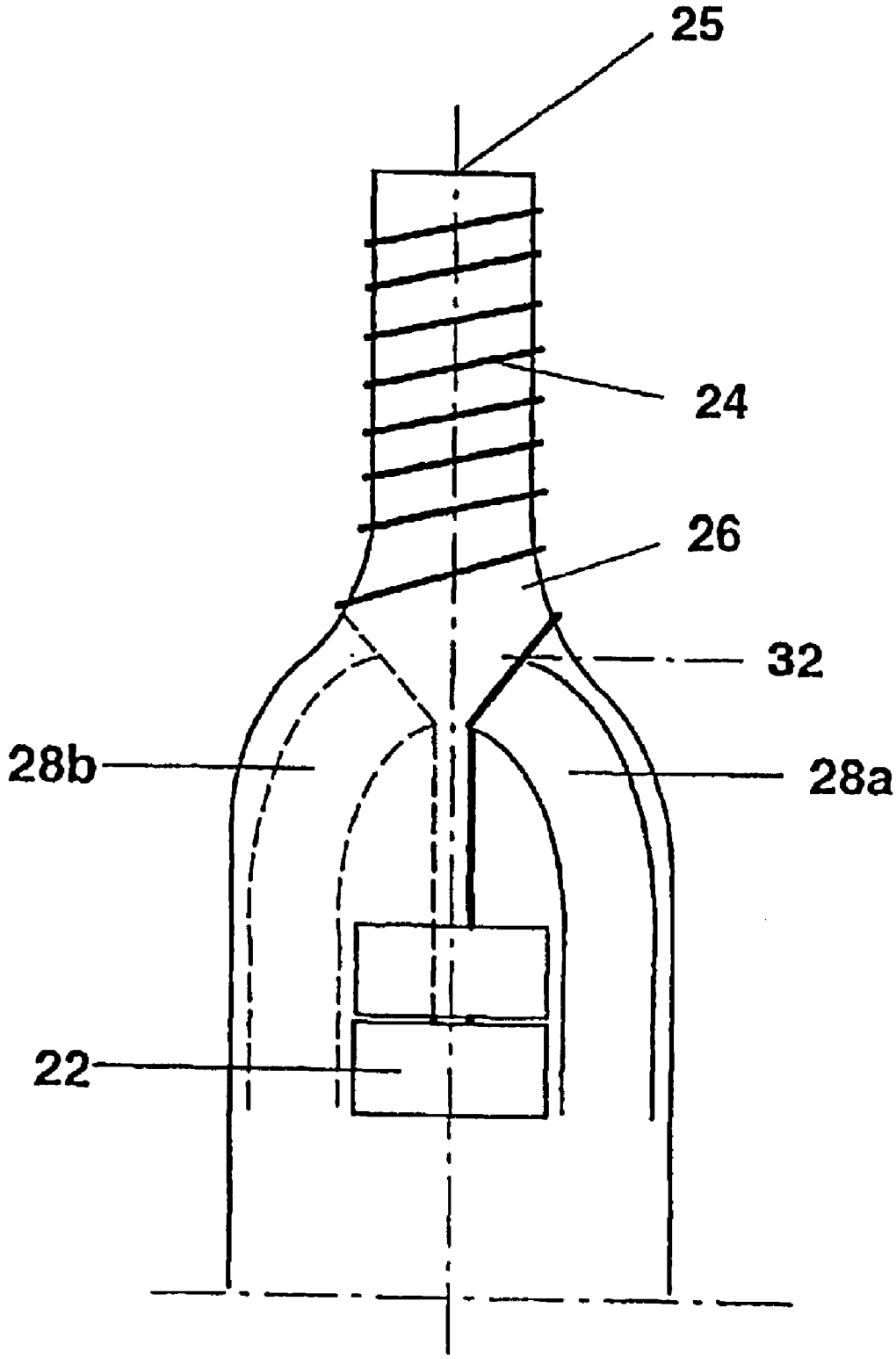
FIG. 3 shows a detailed view of a winding spindle such as is used in the method of production according to the invention and in the device for carrying out the method of production.

FIG. 2*a* shows two wire leads 22*a*, 22*b* between which there is stretched the wire 24 that forms the luminous element 10 and opposite which a winding spindle 26 is situated. The winding spindle 26 has a bent-over section 8 to which the discussion will return once more later. FIG. 2*b*, FIG. 2*c* and FIG. 2*d* show how the wire 24 is inserted into a notch 30 on the narrow end 25 of the winding spindle 26, and the wire 24 is subsequently wound on the winding spindle 26 in a desired way, compare FIG. 1, by rotation and appropriate forward movement of the winding spindle 26. The feeds 22*a*, 22*b* release wire in this case under tension. The diameter of the winding spindle 26 increases continuously from its narrow end 25 up to the winding section 32. As soon as the wire 24 reaches the winding end section 32, it is bent over the bent-over sections 28*a*, 28*b* in such a way that the terminals 18, 20 of the luminous element 10 are orientated in the direction of the longitudinal axis of the winding spindle 26, compare FIG. 2*e* and FIG. 2*f*. A bent-over section 28 is provided for each of the two terminals, the two bend over sections 28*a*, 28*b* being situated symmetrically opposite one another with reference to the winding spindle. FIG. 3 shows an enlarged illustration of the winding spindle 26 with wire 24 wound thereon, and the two bent-over sections 28*a*, 28*b*. The luminous element 10 is drawn off from the winding spindle 26 after the wire has been bent over on the bent-over sections 28*a*, 28*b*. The feeds 22*a* and 22*b* can be separated before or after drawing off.

In order to produce luminous elements 10 of different length, it can be provided that the bent-over sections 28*a*, 28*b* can be adjusted along the region of the winding spindle 26 that is distinguished by a continuous increase in its diameter. The winding end section 32 can be varied as a result.

What is claimed is:

1. A luminous element for an incandescent lamp, the luminous element having a shape of a double helix with two terminals arranged at one end of the double helix, wherein a diameter of the double helix increases continuously in a direction of the two terminals of the luminous element, and wherein a lead of turns of the double helix increases continuously in the direction of the two terminals of the luminous element.

2. The luminous element as claimed in claim 1, wherein the continuous increase in the diameter of the double helix and the continuous increase in the lead of the turns of the double helix each comprise one of a linear, quadratic, cubic and exponential increase.

3. An incandescent lamp having a luminous element as claimed in claim 2.

4. An incandescent lamp having a luminous element as claimed in claim 1.

5. A method for producing a luminous element, comprising:

a. fixing a wire forming the luminous element on a first end of a rotationally symmetrical winding spindle whose diameter increases continuously from the first end up to a winding end section;

b. winding the wire on the winding spindle between first end and the winding end section, wherein turns of the wire are arranged offset on the winding spindle; and c. drawing the luminous element off from the winding spindle.

6. The method as claimed in claim 5, wherein in step a) the wire is inserted into a notch on the first end of the winding spindle.

7. The method as claimed in claim 6, wherein after step b) and before step c) each free wire end is bent over on a bent-over section of the winding spindle such that after being bent over, the wire ends are orientated substantially in a direction of a longitudinal axis of the winding spindle.

8. The method as claimed in claim 7, wherein step b) is performed in such a way that a lead of windings on the winding spindle increases continuously from the first end of the winding spindle to the winding end section.

9. The method as claimed in claim 8, wherein the continuous increase in the diameter of the winding spindle and the continuous increase in the lead of the windings each comprise one of a linear, quadratic, cubic and exponential increase.

10. The method as claimed in claim that wherein the continuous increase comprises one of a linear, quadratic, cubic and exponential increase.

11. The method as claimed in claim 6, wherein step b) is performed in such a way that a lead of windings on the winding spindle increases continuously from the first end of the winding spindle to the winding end section.

12. The method as claimed in claim 11, wherein the continuous increase in the diameter of the winding spindle and the continuous increase in the lead of the windings each comprise one of a linear, quadratic, cubic or and exponential increase.

13. The method as claimed in claim 6, that wherein the continuous increase comprises one of a linear, quadratic, cubic and exponential increase.

14. The method as claimed in claim 5, wherein after step b) and before step c) each free wire end is bent over on a bent-over section of the winding spindle such that after being bent over, the wire ends are orientated substantially in a direction of a longitudinal axis of the winding spindle.

15. The method as claimed in claim 14, wherein step b) is performed in such a way that a lead of windings on the winding spindle increases continuously from the first end of the winding spindle to the winding end section.

16. The method as claimed in claim 15, wherein the continuous increase in the diameter of the winding spindle and the continuous increase in the lead of the windings each comprise one of a linear, quadratic, cubic and exponential increase.

17. The method as claimed in claim 14, wherein the continuous increase comprises one of a linear, quadratic, cubic and exponential increase.

18. The method as claimed in claim 5, wherein step b) is performed in such a way that a lead of the windings on the winding spindle increases continuously from the first end of the winding spindle to the winding end section.

19. The method as claimed in claim 18, wherein the continuous increase in the diameter of the winding spindle and the continuous increase in the lead of the windings each comprise one of a linear, quadratic, cubic and exponential increase.

20. The method as claimed in claim 5, wherein the continuous increase comprises one of a linear, quadratic, cubic and exponential increase.

* * * * *